US007013633B2

(12) United States Patent
Dicic

(10) Patent No.: US 7,013,633 B2
(45) Date of Patent: Mar. 21, 2006

(54) EXTERNAL COMBUSTION THERMAL ENGINE

(76) Inventor: Zoran Dicic, 8 Kensington Rd., Ardsley, NY (US) 10502

( * ) Notice: Subject to any disclaimer, the term of this patent is extended or adjusted under 35 U.S.C. 154(b) by 145 days.

(21) Appl. No.: 10/830,746

(22) Filed: Apr. 23, 2004

(65) Prior Publication Data

US 2005/0235624 A1 Oct. 27, 2005

(51) Int. Cl.

| | |
|---|---|
| ***F02C 5/00*** | (2006.01) |
| ***F02C 9/00*** | (2006.01) |
| ***F02G 1/00*** | (2006.01) |
| ***F02G 3/00*** | (2006.01) |

(52) U.S. Cl. ..... 60/39.6; 60/39.63

(58) Field of Classification Search ..... 60/39.6, 60/39.63

See application file for complete search history.

(56) References Cited

U.S. PATENT DOCUMENTS

| | | | | |
|---|---|---|---|---|
| 431,729 | A * | 7/1890 | Ericsson | 60/516 |
| 4,015,424 | A * | 4/1977 | Shinohara | 60/39.6 |
| 4,133,172 | A * | 1/1979 | Cataldo | 60/39.63 |
| 4,553,385 | A * | 11/1985 | Lamont | 60/39.6 |
| 4,864,814 | A * | 9/1989 | Albert | 60/39.63 |
| 5,074,110 | A * | 12/1991 | Singh | 60/39.63 |
| 5,109,666 | A * | 5/1992 | Eickmann | 60/39.6 |
| 5,894,729 | A | 4/1999 | Proeschel | |
| 6,257,191 | B1 * | 7/2001 | Kutlucinar | 123/190.6 |
| 6,318,068 | B1 * | 11/2001 | Shaw | 60/39.6 |
| 6,470,683 | B1 * | 10/2002 | Childs et al. | 60/39.6 |
| 6,718,751 | B1 * | 4/2004 | Mehail | 60/39.6 |
| 6,886,326 | B1 * | 5/2005 | Holtzapple et al. | 60/39.6 |
| 2003/0061795 | A1 | 4/2003 | Mehail | |
| 2003/0106301 | A1 | 6/2003 | Holtzapple | |

FOREIGN PATENT DOCUMENTS

| | | |
|---|---|---|
| WO | WO 97/28362 | 8/1997 |

OTHER PUBLICATIONS

T. A. Johansen et al, Free-Piston Diesel Engine Dynamics and Control, www.itk.ntnu.no/ansatte/Johansen_Tor.Arne/klc_acc.pdf (2004).

* cited by examiner

*Primary Examiner*—Sheldon J Richter
(74) *Attorney, Agent, or Firm*—Law Office of Leo Zucker

(57) ABSTRACT

An engine block has one or more cylinders with associated pistons connected to turn a crankshaft. A distributor housing mounted on the block has a base with one or more first ports that open into corresponding cylinders. A hollow cylindrical distributor mounted for rotation in the distributor housing has one or more second ports formed in its circumference to align with the first ports in the housing base, at corresponding angular positions of the distributor. A combustor housing forms a combustion chamber with a fuel inlet, an air inlet, and a hot gas outlet. The combustor housing is joined to the distributor housing so that the combustion chamber opens into the interior of the distributor. A turbine plant has a gas inlet connected to the gas outlet on the combustor housing, and an output shaft that drives a compressor. The compressor has an air outlet connected to the air inlet on the combustor housing for supplying air to the combustion chamber. A timing mechanism is arranged between the crankshaft and the distributor so that when a given piston starts its work stroke, a second port in the distributor begins to coincide with a first port that opens into the corresponding cylinder, and hot gas charges under pressure through both ports to power the piston work stroke.

14 Claims, 4 Drawing Sheets

EXTERNAL COMBUSTION THERMAL ENGINE

BACKGROUND OF THE INVENTION

1. Field of the Invention

This invention relates to external combustion heat engines.

2. Discussion of the Known Art

Typical external combustion engines include steam engines and so-called Stirling-cycle engines. In contrast to internal combustion engines wherein a liquid or gaseous fuel is repeatedly ignited and burned inside one or more working cylinders, external combustion engines are characterized in that they burn fuel continuously in a chamber that is separate from a cylinder or other space where useful work is produced by the engine.

U.S. Pat. No. 431,729 (Jul. 8, 1890) in the name of John Ericsson discloses an air engine having a working cylinder, a supply cylinder, and an air heater. Work and supply pistons associated with the two cylinders are connected to reciprocate in unison with one another, and the work piston is connected by a rod to a crankshaft having a flywheel. Outside air is admitted into the supply cylinder through a first timed valve mechanism and, upon a compression stroke of the supply piston, is piped into a jacket that surrounds the heater. Hot air from the heater is then admitted into the working cylinder through a second timed valve mechanism to initiate a work stroke of the work piston. See also U.S. Pat. No. 5,894,729 (Apr. 20, 1999) which discloses an afterburning Ericsson cycle engine.

International Application No. PCT/NO97/00022 (WO 97/28362) published Aug. 7, 1997, discloses a two-cycle free-piston diesel gas generator, wherein a pair of free pistons are disposed inside a single cylinder for synchronously opposed reciprocating movement. Heated gas is produced from combusted fuel inside the cylinder, and the gas is expelled by the pistons to be used, for example, to power an external gas turbine. See also, T. A. Johansen, et al., "Free-Piston Diesel Engine Dynamics and Control" (www.itk.ntnu.no/ansatte/Johansen_Tor.Arne/klc_acc. pdf), which also discloses the concept of using a free-piston diesel or "Pescara" engine for producing a supply of hot gas which is used to fuel a turbine power plant.

As far as is known, an engine wherein an externally combusted hot gas product is charged under pressure with a determined timing into a working cylinder of the engine, and a piston in the cylinder is urged by the pressurized gas product to rotate a crankshaft from which power can be taken, has not been disclosed.

SUMMARY OF THE INVENTION

According to the invention, an external combustion engine includes an engine block with one or more cylinders, and a corresponding number of pistons arranged for reciprocating movement inside the cylinders. An engine crankshaft is connected to each piston and is supported for rotation in response to a work stroke of each piston. A distributor housing is mounted on the block, and the housing includes a base having one or more first ports that open into corresponding cylinders. A hollow cylindrical distributor is mounted for rotational movement in the distributor housing, and one or more second ports are formed in the circumference of the distributor so that each second port registers with a corresponding first port in the distributor housing base at determined angular positions of the distributor.

A combustor housing has a fuel inlet, an air inlet, and a hot gas outlet, and the housing forms a combustion chamber. The combustor and the distributor housings are joined so that the combustion chamber opens into the interior of the distributor. A turbine plant has a gas inlet connected with the gas outlet on the combustor housing, and an output shaft that drives a compressor whose air outlet is connected to the air inlet on the combustor housing.

A timing mechanism is arranged between the crankshaft and the distributor so that when the crankshaft is approximately at a position where a piston starts its work stroke in an associated cylinder, a second port in the distributor starts to coincide with the first port in the distributor housing base that opens into the cylinder. Thus, hot gas charges under pressure from inside the distributor, through the coincident ports, and into the cylinder to power the work stroke of the piston.

According to another aspect of the invention, a method of powering an engine having one or more working cylinders and associated pistons arranged to perform work strokes inside the cylinders, includes combusting a fuel in an external combustion chamber thereby producing heated combustion products, and supplying a gas turbine plant with the heated combustion products to drive the turbine plant. An output of the turbine plant is coupled to a compressor for obtaining a supply of pressurized air, and the pressurized air is directed to the combustion chamber for producing a pressurized hot gas. The combustion chamber is opened into a distributor device that operates to charge the pressurized hot gas into each cylinder of the engine at such timing as to urge the associated piston through a corresponding work stroke.

For a better understanding of the invention, reference is made to the following description taken in conjunction with the accompanying drawing and the appended claims.

DETAILED DESCRIPTION OF THE INVENTION

Figure 1:
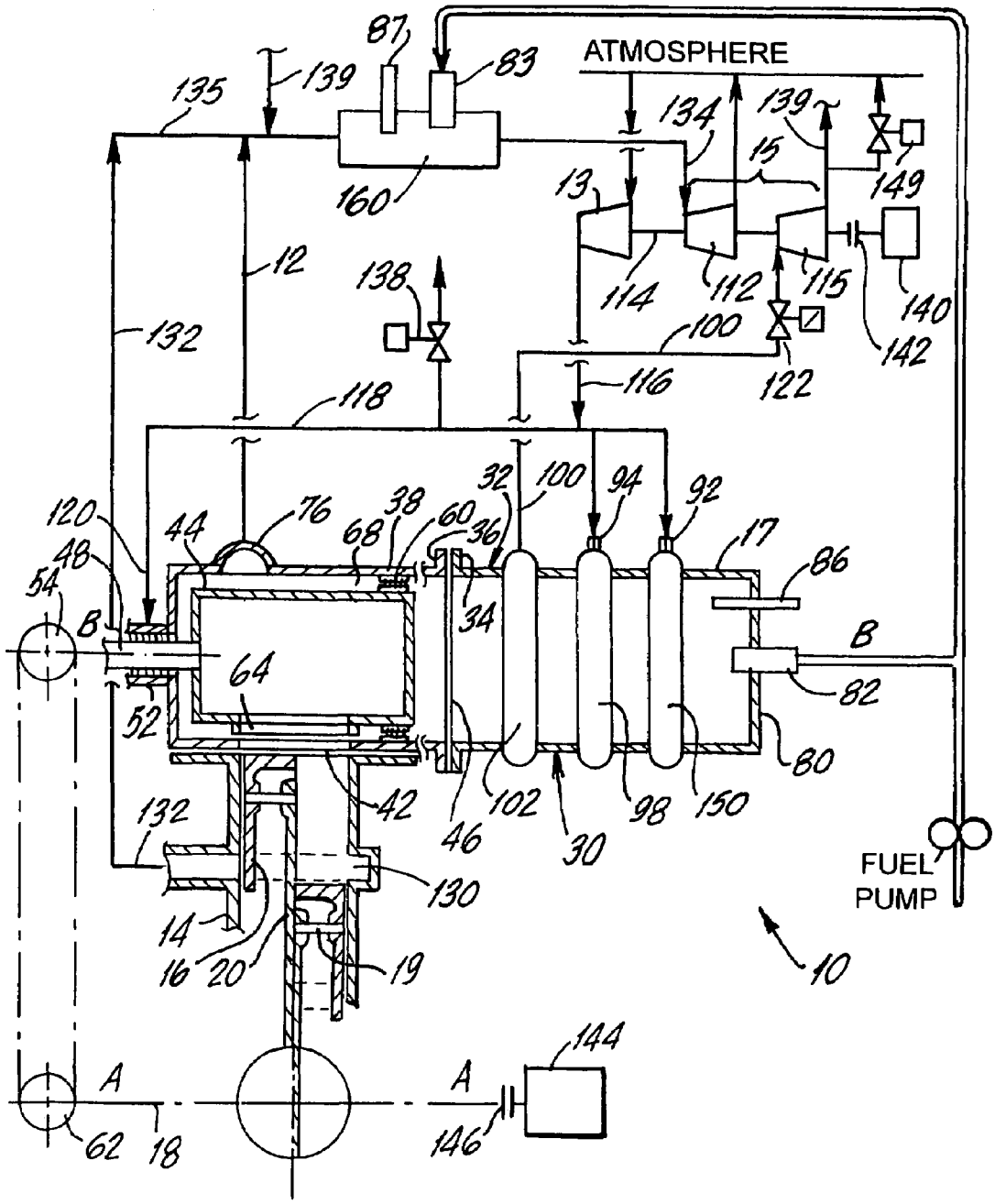
FIG.1 is a block diagram showing basic components of an external combustion engine according to the invention.

FIG. 1 is a block diagram of one embodiment of an external combustion heat engine 10 according to the invention. Basically, the engine includes an engine block 12 (see FIGS. 2 and 3) that develops usable power, an external compressor 13 driven by a two stage gas turbine plant 15, and an external combustor 17 that supplies hot gas to the engine block 12 and to the plant 15 for driving the compressor 13. The engine 10 delivers improved fuel economy with reduced emissions, and is fairly easy to manufacture and operate. The engine is also relatively inexpensive to maintain, and can run on a variety of liquid and gaseous fuels.

Figure 2:
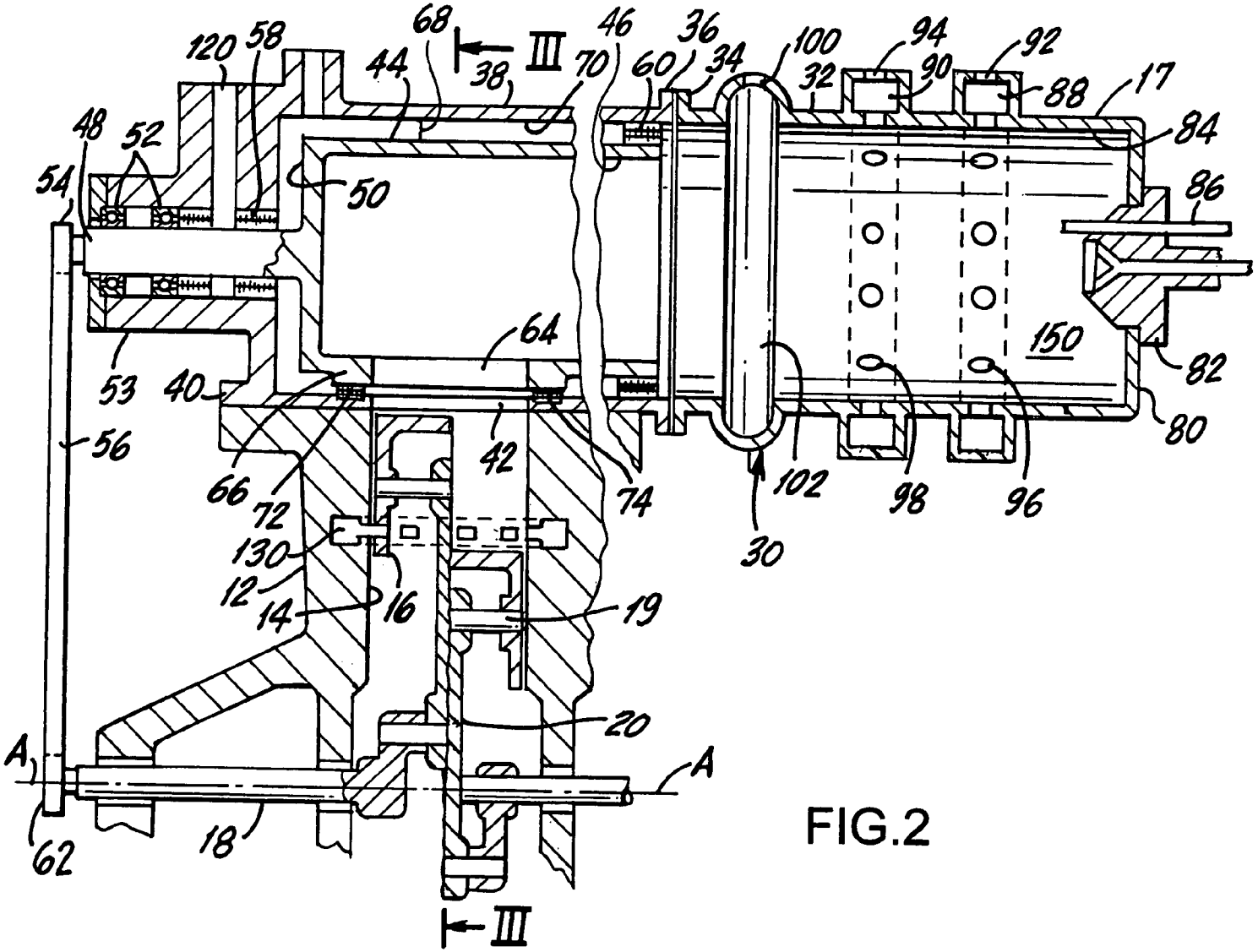
FIG. 2 is a cross-sectional view of a combustor/distributor assembly and an engine block according to the invention.
Figure 3B:
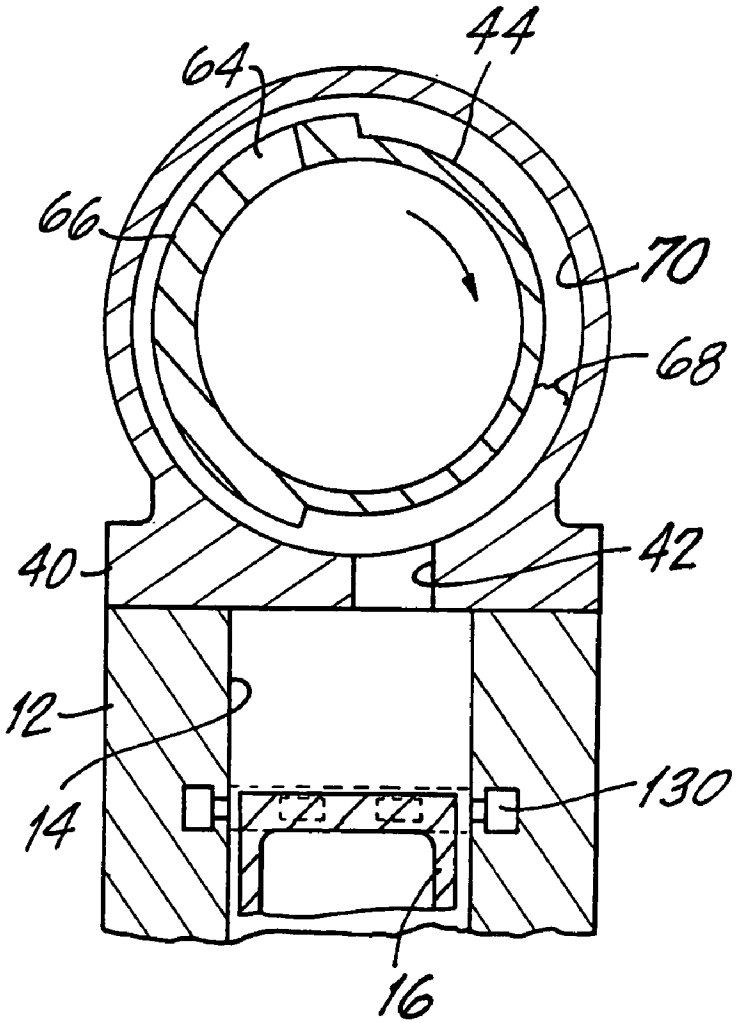
FIGS. 3(*a*) and 3(*b*) are cross-sectional views of the combustor/distributor assembly taken along line III—III in FIG. 2, and correspond to top and bottom positions of a piston in the engine block.
Figure 3A:
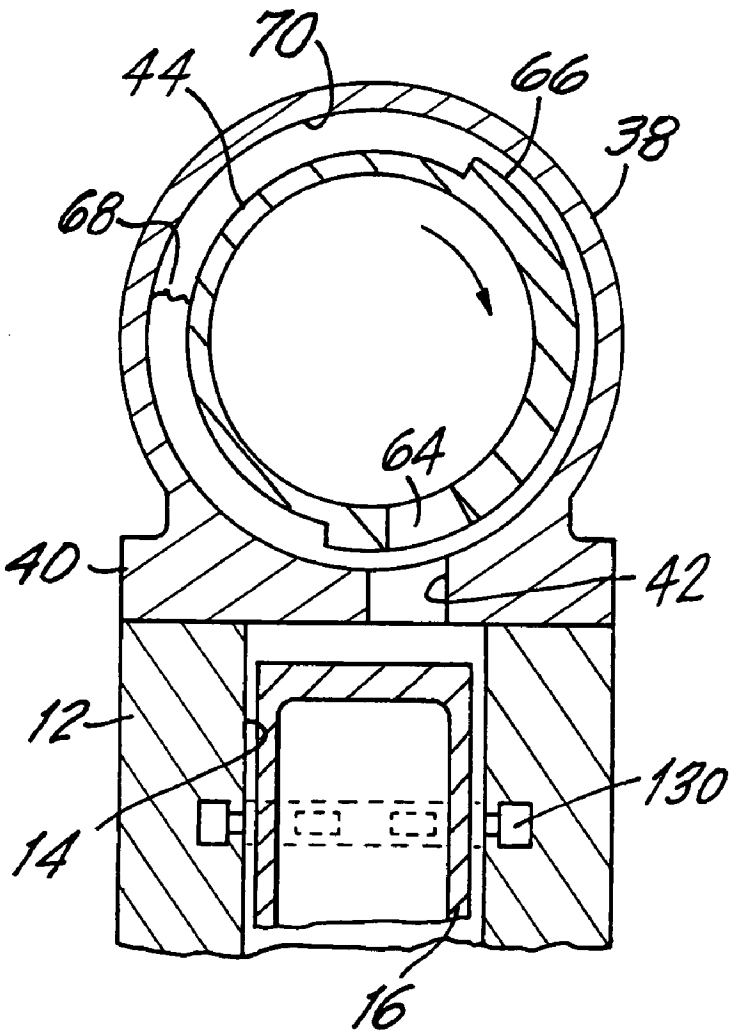

The engine block 12 may have one or more working cylinders. In the illustrated embodiment, the block has one cylinder 14, and a working piston 16 is arranged for reciprocating movement inside the cylinder between a top position and a bottom position as depicted in FIGS. 1, 2, 3(*a*) & 3(*b*). The engine block 12 has an associated crankshaft 18 which, as best shown in FIG. 2, is supported within the block for rotation about an axis A of the crankshaft. The piston 16 is connected in a conventional manner to the crankshaft 18 by way of a gudgeon pin 19 and a connecting rod 20, as seen in FIG. 2 for both the top and the bottom positions of the piston. Accordingly, when the piston is powered through a work stroke starting from the top position, the connecting rod 20 urges the crankshaft 18 to rotate about axis A so as to deliver useful engine power from the rotating shaft. As mentioned, the engine block 12 may have two or more working pistons arranged for reciprocating movement inside associated cylinders (not shown), wherein all of the pistons are connected through associated connecting rods to the crankshaft 18 in a conventional manner.

A combustor/distributor assembly 30 is mounted atop the engine block 12. The assembly 30 comprises a generally cylindrical combustor housing 32 that has an open axial end 34, and a generally cylindrical distributor housing 38 having an open axial end 36. Both of the housings 32, 38 are joined in axial alignment by way of, e.g., mating flanges at their open ends 34, 36. Further details of the combustor housing 32 are set out later below.

The distributor housing 38 is formed with a base 40 that is fixed to the engine block 12 over the open top of the cylinder 14. An aperture or port 42 is formed in the distributor housing base 40 so as to communicate freely with an upper region of the engine cylinder 14, over the top of the piston 16.

A hollow cylindrical distributor 44 is mounted inside the distributor housing 38 for rotational movement about an axis B of the distributor, and an open axial end 46 of the distributor faces and communicates with the open axial end 34 of the combustor housing 32. As shown in FIG. 2, a distributor shaft 48 projects outward from a closed end wall 50 of the distributor along the distributor axis B, and the shaft 48 is supported by a pair of bearings 52 that are seated in a collar 53 formed at an end of the distributor housing 38 opposite the open axial end 36 of the housing. A timing belt pulley or chain sprocket 54 is fixed concentrically to the free end of the distributor shaft 48 outside the distributor housing 38. A gas seal 58 is preferably seated in the collar 53, concentric with the shaft 48 and at a location between the interior of the distributor housing 38 and the bearings 52.

An annular gas seal 60 is also seated on the inner periphery of the distributor housing 38, to maintain contact with the outer circumference of the distributor 44 at its open axial end 46. A timing belt pulley or chain sprocket 62 is fixed concentrically to the free end of the engine crankshaft 18 outside of the engine block 12, below the pulley or sprocket 54 on the distributor shaft 48. A timing belt or chain 56 (FIG. 2) engages the pulleys or sprockets 54, 62, so as to drive the distributor shaft 48 to rotate in response to rotation of the engine crankshaft 18. In the illustrated embodiment, the drive ratio between the engine crankshaft 18 and the distributor shaft 48, is 1 to 1.

The distributor 44 also has an aperture or port 64 formed in its cylindrical wall so that the port 64 coincides or registers with the port 42 in the distributor housing base 40 at a determined angular position (or range of positions) of the distributor, such as the position shown in FIG. 3(*a*). The angular positions at which the port 64 in the distributor wall coincides with the port 42 in the base wall 40, preferably corresponds to positions of the piston 16 at and near the top position shown in FIG. 3(*a*).

Figure 4:
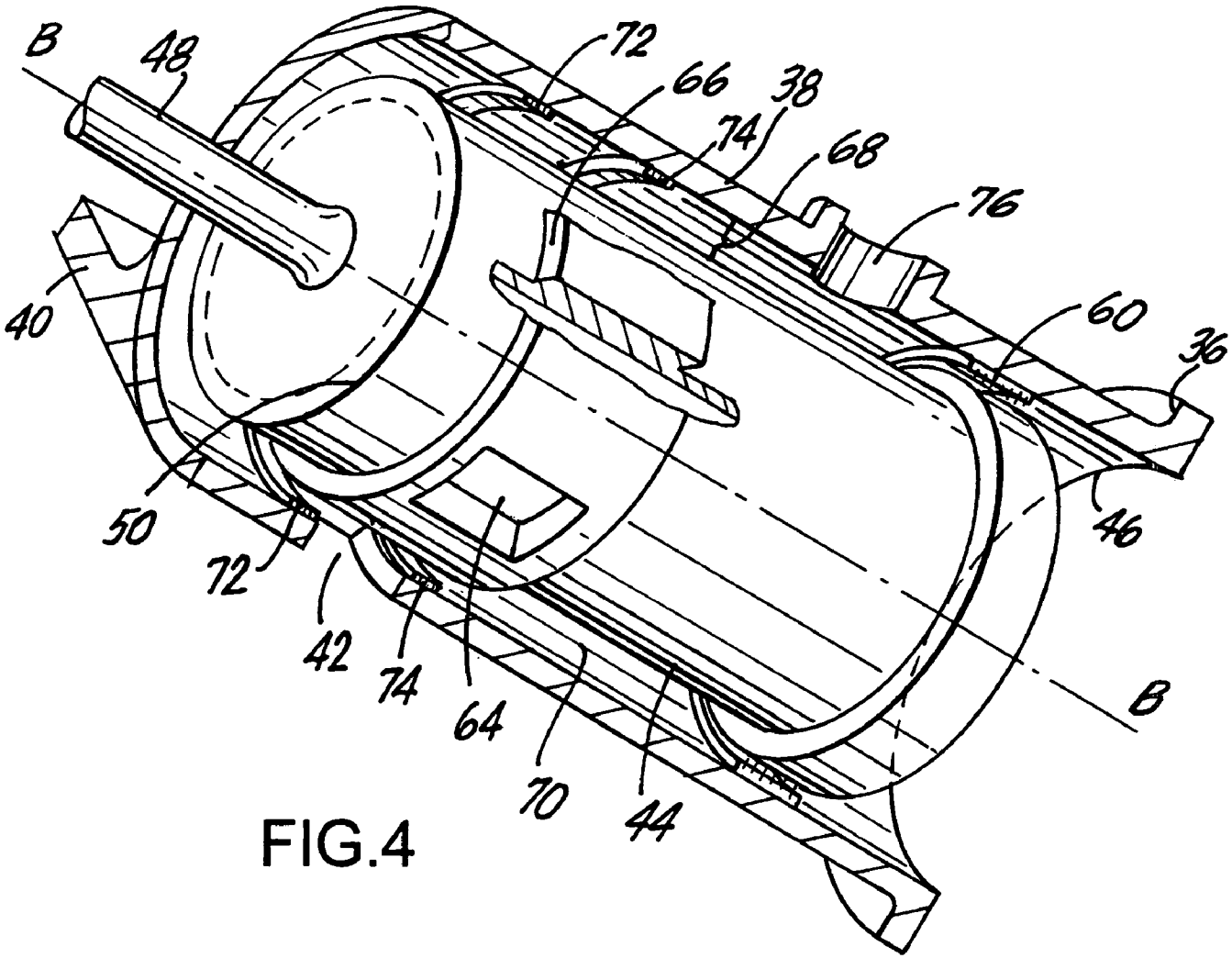
FIG. 4 is a perspective view of a distributor according to the invention, wherein a portion of a distributor housing is broken away for purposes of illustration.

FIGS. 3(*a*) and 3(*b*) are cross-sectional views of the distributor housing 38 and distributor 44 taken along line III—III in FIG. 2. FIG. 4 is a perspective view of the distributor housing 38 with a portion of the housing removed to show details of the cylindrical distributor 44. In FIG. 4, the distributor is at an angular position where the port 64 in its cylindrical wall is approximately 90 degrees away from the port 42 in the distributor housing base. The port 64 is formed through a radially raised or "shutter" portion 66 that subtends an arc of approximately 180 degrees about the circumference of the distributor. As seen in FIG. 3(*a*), when the port 64 in the distributor wall is coincident with the port 42 in the distributor housing base 40, the shutter portion 66 is closely juxtaposed to the inner periphery of the distributor housing 38 at both sides of the port 42. Leakage of pressurized hot gas to be charged through the ports 42, 64 from inside the distributor, is thus minimized.

As shown in FIG. 4, a pair of axially spaced annular labyrinth seal rings 72, 74 may be seated in the inner periphery of the distributor housing 38, so as to maintain sealing contact with both circumferential edges of the shutter portion 66 and thus enhance gas sealing about the port 64 in the shutter portion 66 when port 64 is aligned with port 42 in the housing base 40. The seal rings 72, 74 also prevent hot gases produced inside the combustor housing 32 from entering an exhaust space 68 that is defined between the outer circumference of the distributor 44 (excluding the raised shutter portion 66) and the inner periphery 70 of the distributor housing 38, between the seals 58, 60. An exhaust port 76 is formed through the distributor housing to communicate with the exhaust space 68.

Both of the ports 42, 64 may be generally rectangular in shape, and of such dimensions as to register fully within the circumference of the top opening of the cylinder 14 at certain angular positions of the distributor 44. The port 64 in the raised shutter portion 66 may have the same width as the port 42 in the combustor housing, while the circumferential length of the port 64 may differ from that of the port 42. The circumferential length of the port 64 is a factor that determines the quantity of hot gas that is to be charged into the cylinder 14 from within the distributor 44 during operation of the engine 10, as explained further below.

Rotation of the distributor 44 with its shutter portion 66 is synchronized with rotation of the engine crankshaft 18, so that the ports 64, 42 in the shutter portion and the distributor housing base will coincide to admit pressurized hot gas into the cylinder 14, preferably just after the piston 16 moves past the top position (TDC) shown in FIG. 3(*a*). For example, the ports may start to coincide to charge the cylinder with a delay of approximately 10 degrees after TDC. As shown in FIG. 3(*b*), when the distributor 44 is at such a rotational position that the raised shutter portion 66 is clear of the port 42 in the distributor housing base, gas is free to escape out the top of the cylinder 14 through the port 42, and to pass into the exhaust space 68 within the distributor housing 38.

Besides having an interior region where combustion of gases may be completed, the distributor 44 performs a number of important functions; namely, to distribute pressurized hot gas through a port in one or more raised shutter portions at a determined timing to the cylinder(s) in the engine block 12 (FIG. 3(*a*)); to seal closed the top of each cylinder during a work stroke of each piston; and to open a passage for exhausting gas from the cylinder(s) into the exhaust space 68 during a purge stroke of each piston (FIG. 3(*b*)). The circumferential length of each shutter portion should therefore correspond to the angle of rotation of the crankshaft 18 during the work stroke of each associated piston.

The combustor housing 32 has a closed axial end wall 80 as seen at the right in FIGS. 1 and 2. A fuel inlet 82 is constructed and arranged to inject an outside supply of liquid or gaseous fuel into a combustion chamber 84 that is defined within the combustor housing 32. A fuel igniter 86 has an associated terminal outside the end wall 80, and the igniter projects into the combustion chamber 84. Depending on the particular fuel to be used for the engine 10, the igniter 86 may be either a conventional spark plug or a glow plug. Also, to reduce NOx combustion products and increase efficiency, a measured amount water may be combined in a known manner with fuel supplied to the inlet 82 on the chamber 84. A conventional fuel pump may provide a desired fuel injection pressure.

FIG. 2 includes a cross-section of the combustor housing 32 and interior combustion chamber 84. The housing 32 is formed with two radially raised, annular air intake manifolds 88, 90 on the outer periphery of the housing. Manifold 88 is located a certain distance downstream from the end wall 80 of the housing, and manifold 90 is spaced a certain distance apart from the manifold 88. The intake manifolds 88, 90 have associated air inlets 92, 94. Air supplied to the inlets 92, 94 fills annular passages formed inside the manifolds and communicates with the combustion chamber 84 through corresponding sets of circumferentially spaced holes 96, 98 formed in the wall of the combustor housing 32. One or more of the holes 96, 98 in each set may be drilled tangentially (i.e., angularly offset from normal to the combustor housing) so as to induce a swirl effect to streams of air entering the combustion chamber through the holes, thereby improving combustion. A hot gas outlet 100 is formed through the combustor housing wall, and the outlet 100 communicates with an annular increased diameter region 102 in the inner periphery of the combustor housing wall, downstream from the air inlet 94.

The present engine 10 also includes the air compressor 13 (FIG. 1) to which a supply of outside, preferably filtered air is available. Compressor 13 is preferably of a centrifugal type capable of providing a high compression ratio of, e.g., about 20 to 1. A centrifugal type compressor is also preferred for its performance characteristics with respect to rotation speed.

The gas turbine plant 15 includes a low pressure (LP) gas turbine stage 112 having an output shaft 114 that drives the compressor 13, and a high pressure (HP) gas turbine stage 115 that is coupled to drive the shaft 114 in common with the LP turbine stage 112. Pressurized air supplied from the compressor 13 is conducted through a conduit 116 that branches to the first and the second air inlets 92, 94 of the combustor housing 32. A second HP air conduit 118 communicates pressurized air from the compressor 13 to a passage 120 in the distributor housing 38, to aid in sealing the distributor shaft 48 for preventing gas leakage, and for maintaining the shaft bearings 52 at safe temperatures. High pressure hot gas developed inside the combustion chamber 84 at the region 102, is conducted from the gas outlet 100 and through a throttle device 122, to a gas inlet of the HP gas turbine stage 115.

It is preferred that the piston 16 operate under a two-stroke cycle. Thus, an annular piston exhaust region 130 is formed in the wall of the cylinder 14 to rise just above the top of the piston when the piston is at the bottom position in the cylinder shown in FIG. 3(*b*), corresponding to the end of a work (expansion) stroke. As the piston top moves past the region 130 at the end of the work stroke (see FIG. 2, right of piston center line), expanded gas enters the region and is led through a conduit 132 through a manifold 135 and to a gas inlet 134 of the LP turbine stage 112. The exhaust port 76 on the distributor housing is also connected to help purge waste gas from the exhaust space 68 to the gas inlet 134 of the LP turbine stage 112.

The HP turbine stage 115 is supplied with hot gas directly from the combustor housing 32. The shaft output of the HP turbine stage therefore determines the output of the compressor 13 which, when combined with fuel input, determines power output of the engine 10. The gas supply to the HP turbine stage 115 is therefore throttled or regulated to meet instant power demands of the engine, and is a primary means for controlling the engine power output. The combustion chamber 84 must therefore have sufficient volume to enable the HP turbine stage 115 to operate so as to meet anticipated power demands without significantly affecting engine performance.

The contribution of the LP turbine stage 112 toward powering the compressor 13 may be less than that provided by the HP turbine stage 115. The LP turbine stage 112 is driven by waste gases and may operate on an unregulated basis, its primary function being to improve engine efficiency. As shown in FIG. 1, a reheater 160 with igniter 87 and injector 83 may form part of the manifold 135 that leads exhaust gases to the input 134 of the LP stage 112. The reheater 160 may be a direct heater since there is excess air in the exhaust gases, and such an arrangement may well improve engine efficiency.

When the piston 16 starts a purge stroke by returning toward the top position, the exhaust region 130 is closed by the piston wall to prevent back flow of exhaust gas into a crankshaft cavity in the engine block below the cylinder 14. Rotation of the engine crankshaft 18 is synchronized with the rotation of the distributor 44 so that the raised shutter portion 66 on the distributor clears the port 42 in the distributor housing base at the beginning of the purge (return) stroke of the piston 16, and gas in the cylinder purges freely into the exhaust space 68 by the upward return stroke of the piston. See FIG. 3(*b*).

Conduits leading to and from the turbine stages 112, 115, the compressor 13, the combustor housing 32 and the engine block 12, enable air to flow between the compressor and the combustor housing, and hot gas to flow between the combustor housing and the HP turbine stage 115. The conduits incorporate such control devices (e.g., air flow measuring devices, control valves, back flow preventers, relief valves, sensors, and the like) as may be required for starting the engine 10, and for the running of the engine.

As seen in FIG. 1, a first starting motor 140 is arranged to start the turbine stages 112, 115 through a first disconnect clutch 142. A second starting motor 144 is arranged to initiate rotation of the crankshaft 18 through a second disconnect clutch 146.

OPERATION

The engine 10 may be started by energizing the motor 140 that drives the compressor 13 through the common shaft 114, and energizing the clutch 142 until the compressor 13 supplies a sufficient quantity of air to initiate fuel delivery and ignition. During initial startup, a relief valve 138 is opened and air from the compressor 13 is discharged to atmosphere. Also, the HP turbine stage 115 exhausts hot gas directly to atmosphere through a relieve valve 139, bypassing the LP stage 112. Basically, the HP stage 115 may start like a conventional gas turbine using a silo type combustor.

The engine crankshaft 18 is preferably locked while the HP turbine stage 115 is started, so as to prevent the engine 10 from idling solely on compressed air prior to ignition. One example of a locking device is a friction brake that is urged by a spring against a flywheel (not shown) on the crankshaft 18. An air-operated piston may then be provided to counter the spring force once sufficient air pressure is developed. Unlocking of the crankshaft 18 may be synchronized with the start of the crankshaft starting motor 144. The locking device should be disabled while the engine is running to prevent accidental locking of the crankshaft 18.

Once sufficient hot gas production in the combustion chamber 84 is sensed, the crankshaft starting motor 144 is energized to turn the crankshaft 18 which then drives the distributor shaft 48 (through the chain or timing belt 56) to a position where port 64 in the distributor shutter portion 66 coincides with port 42 in the distributor housing base, and the cylinder 14 is charged with pressurized hot gas so as to start a work stroke of the piston 16. After crankshaft rotation is established, the starting motor 144 is disengaged by opening the clutch 146. Both the crankshaft locking device and the starting motor may act on the crankshaft flywheel. Because the piston 16 is initially exposed to the full pressure of the hot gas present inside the distributor 44, the engine 10 is capable of providing relatively high torque at low crankshaft speeds. Since combustion does not take place inside the engine cylinder 14, the temperature of the pressurized gas that powers the piston 16 may be lower than that which develops inside cylinders of conventional internal combustion engines.

As mentioned, the air flow from the compressor 13 is branched into two streams. A stream of primary air is supplied to the first air inlet 92 on the combustor housing 32 to enter the manifold 88 (FIG. 2) in which the air is pre-heated, before entering a pre-chamber region 150 of the combustion chamber through holes 96 in the housing wall. The quantity of air entering the pre-chamber region 150 is preferably only sufficient to obtain sub-stoichiometric combustion when mixed with fuel and ignited in the pre-chamber region 150. Combustion products then enter a transition region 152 into which a stream of secondary air from the compressor 13 is admitted to complete fuel combustion. The secondary air is supplied to the second air inlet 94 on the combustor housing to enter the manifold 90 and undergo a certain degree of pre-heating before entering the transition region 152 through the holes 98 in the housing wall. The secondary air is provided to achieve a desired gas mass flow and temperature. From the transition region 152, hot gas enters the interior of the distributor 44 where combustion is completed and temperature equalization occurs. The working fluid eventually charged into the cylinder 14 to urge the piston 16 through a work stroke, is actually a pressurized mixture of heated air and combustion products.

Due to high combustion temperatures in the order of about 3500° F. in the pre-chamber region 150, heat is transferred to the cooler air that is being supplied to the first air manifold 88 on the combustor housing. Internal surfaces of the manifold 88 may be ribbed to enhance the heat transfer. Liquid fuels may be preconditioned to enhance the combustion process by pre-heating, atomization, or evaporation. The outlet 100 which supplies hot gas to the HP turbine stage 115 is located downstream of the second air inlet 94. Because of the secondary air supply, the temperature in the transition region 152 is maintained below 2200° F., thus significantly reducing NOx emissions.

The work developed by the cylinder 14 is a function of cylinder size, the quantity of hot gas charged into the cylinder, and the temperature and pressure of the gas. The amount of hot gas injected into the cylinder is determined by the size of the ports 64, 42 in the distributor shutter portion and the distributor housing, as well as the instantaneous rotational speed of the shutter portion.

Owing to known characteristics of centrifugal type compressors, the power output and torque developed at the engine crankshaft 18 may also be controlled by varying the speed of the compressor 13 (assuming, without limitation, that the compressor 13 is a centrifugal type). This mode enables the engine 10 to increase power output without a significant increase in speed. Besides decreasing the speed of the HP turbine stage 115 by throttling the flow of hot gas to the stage, a call for a sudden reduction of engine power may be handled by the use of an air relief valve arranged to reduce quickly the flow of air supplied to the combustor housing.

The components of the combustor/distributor assembly 30 are preferably formed from high temperature resistant alloys. Being generally cylindrical in shape, they should tolerate a fast rate of heating without structural harm.

ALTERNATE EMBODIMENTS

While the foregoing represents preferred embodiments of the invention, it will be understood by those skilled in the art that various modifications and changes may be made without departing from the spirit and scope of the invention.

For example, in the drawing, the combustor and the distributor are joined to one another in axial alignment, and the distributor has a single drive shaft with bearings in the collar on one side of the distributor housing. In the event the length of the engine block makes this arrangement unsuitable (e.g., multiple cylinders are formed in-line along the block) and the distributor requires support at both axial ends, the combustor housing may be constructed and arranged to be joined to the distributor housing with its axis perpendicular to that of the distributor housing. The distributor may then have walls with support shafts at both axial ends, and openings may be formed in the cylindrical wall of the distributor away from the shutter portion(s) to allow hot gas and combustion products to pass into the interior of the distributor from the combustor housing.

Also, the compressor 13 and the turbine plant 15 are described above as a single unit with all components on a common shaft. Two separate compressor-turbine plant units may be more efficient, however. In such a case, a low pressure compressor may serve as a booster at an inlet of a high pressure compressor. The low pressure compressor may be driven by a turbine that is powered by exhausted gas and gas leakage, while the high pressure compressor may be powered by a HP turbine supplied with gas from the combustor housing 32. Only the HP turbine would need to be regulated for engine control.

Accordingly, the invention includes all such modifications and changes as come within the scope of the following appended claims.

I claim:

1. An external combustion engine, comprising:

an engine block having one or more cylinders, and a corresponding number of pistons arranged for reciprocating movement inside the cylinders;

an engine crankshaft connected to each piston and supported for rotation about an axis of the crankshaft in response to a work stroke of each piston;

a distributor housing mounted on the engine block, wherein the housing includes a base having one or more first ports that open into corresponding ones of the cylinders;

a hollow cylindrical distributor having an axis and mounted in the distributor housing for rotational movement about said axis, one or more second ports are formed in the circumference of the distributor so that each second port registers with a corresponding first port in the base of the distributor housing at a determined angular position of the distributor;

a combustor housing having a fuel inlet, a first air inlet, and a first gas outlet and forming a combustion chamber, wherein the combustor housing is joined to the distributor housing so that the combustion chamber opens into the interior of the distributor;

a turbine plant having a gas inlet arranged in communication with the first gas outlet on the combustor housing, and an associated-output shaft;

a compressor arranged to be driven by the output shaft of the turbine and having an air outlet coupled to the first air inlet on the combustor housing, for supplying air for fuel combustion in the combustion chamber;

an igniter arranged to initiate combustion of air and fuel in the combustion chamber; and a timing mechanism constructed and arranged between the engine crankshaft and the distributor so that when the crankshaft is approximately at a position where a piston starts a work stroke in an associated cylinder, a second port in the distributor starts to coincide with a first port in the base of the distributor housing which opens into the cylinder, and hot gas charges under pressure from inside the distributor, through the coincident ports, and into the cylinder to power the work stroke of the piston.

2. An engine according to claim 1, wherein the distributor has one or more raised shutter portions that subtend a determined arc about the circumference of the distributor and are juxtaposed to the inner periphery of the distributor housing, and the second ports are formed in the raised shutter portions.

3. An engine according to claim 2, wherein the raised shutter portion subtends an arc of about 180 degrees.

4. An engine according to claim 1, wherein an exhaust space is defined between the outer circumference of the distributor and the inner periphery of the distributor housing, and the distributor housing has an exhaust port in communication with the exhaust space.

5. An engine according to claim 4, wherein the distributor is constructed and arranged so that gas present in a given cylinder of the engine block purges into the exhaust space during a return stroke of the corresponding piston.

6. An engine according to claim 1, wherein the combustor housing has a first air intake manifold associated with the first air inlet, and a first set of circumferentially spaced holes for directing air supplied to the first air inlet into the combustion chamber.

7. An engine according to claim 6, wherein the combustor housing has an end wall, the fuel inlet and the igniter are disposed in the vicinity of the end wall, and the first air intake manifold is located a certain distance downstream from the end wall to define a pre-chamber region of the combustion chamber wherein sub-stoichiometric combustion is obtained with air that enters the pre-chamber region from the first air intake manifold.

8. An engine according to claim 7, wherein the combustor housing has a second air inlet located a certain distance downstream from the first air inlet, a second air intake manifold associated with the second air inlet to define a transition region in the combustion chamber for completing combustion of fuel at a temperature lower than that developed in the pre-chamber region, and a second set of circumferentially spaced holes for directing air supplied to the second air inlet to the transition region.

9. A method of powering an engine having one or more working cylinders and associated pistons arranged to perform work strokes inside the cylinders, comprising:

combusting a fuel in an external combustion chamber, thus producing heated combustion products;

supplying a gas turbine plant with the heated combustion products produced in the combustion chamber to drive the turbine plant;

coupling an output of the turbine plant to a compressor to obtain a supply of pressurized air;

directing the pressurized air from the compressor to the combustion chamber, thus producing a pressurized hot gas; and opening the combustion chamber into a distributor device that is operative to charge the pressurized hot gas into each cylinder of the engine with such a timing as to urge the associated piston through a corresponding work stroke.

10. The method of claim 9, including varying the amount of heated combustion products supplied to the gas turbine plant for controlling a power output of the engine.

11. The method of claim 9, including directing a first branch of the pressurized air from the compressor to a first air inlet of the combustion chamber so as to obtain sub-stoichiometric combustion of the fuel at a first temperature, and directing a second branch of the pressurized air from the compressor to a second air inlet of the combustion chamber for completing combustion of the fuel at a second temperature lower than the first temperature.

12. The method of claim 9, including operating each piston under a two-stroke cycle.

13. The method of claim 9, including supplying the heated combustion products to a HP stage of the gas turbine plant.

14. The method of claim 13, including providing the gas turbine plant with a LP stage in addition to the HP stage, and directing exhaust gas from each cylinder to drive the LP stage.

* * * * *